US007001497B2

(12) United States Patent
Gagné et al.

(10) Patent No.: US 7,001,497 B2
(45) Date of Patent: Feb. 21, 2006

(54) PROCESS AND APPARATUS FOR POSITIONING REPLACEMENT ANODES IN ELECTROLYTIC CELLS

(75) Inventors: Jean Pierre Gagné, Chicoutimi (CA); Gilles Dufour, Québec (CA); Bertrand St-Laurent, Donnacona (CA); Claude Gauthier, Sainte-Foy (CA); Jacques Denis, St-Basile de Portneuf (CA); Robin Boulianne, Jonquiére (CA); Pierre Bouchard, Chitoutimi (CA); Jacques Pelletier, Chitoutimi (CA)

(73) Assignee: Alcoa,Inc., Pittsburgh, PA (US)

( * ) Notice: Subject to any disclaimer, the term of this patent is extended or adjusted under 35 U.S.C. 154(b) by 74 days.

(21) Appl. No.: 10/423,654

(22) Filed: Apr. 25, 2003

(65) Prior Publication Data

US 2004/0211663 A1 Oct. 28, 2004

(51) Int. Cl.
*C25D 21/00* (2006.01)

(52) U.S. Cl. ..... 205/81; 205/96

(58) Field of Classification Search ..... 205/389, 205/80, 81, 96; 204/225, 245; 244/136
See application file for complete search history.

(56) References Cited

U.S. PATENT DOCUMENTS

| | | | | |
|---|---|---|---|---|
| 3,480,526 | A * | 11/1969 | Duclaux | 205/389 |
| 3,850,305 | A | 11/1974 | Messina | 212/21 |
| 4,032,020 | A | 6/1977 | Kato et al. | 214/1 BB |
| 4,221,641 | A * | 9/1980 | Weber et al. | 205/336 |
| 4,465,578 | A | 8/1984 | Duclaux et al. | 204/245 |
| 4,540,474 | A * | 9/1985 | Voegel | 205/512 |
| 4,992,146 | A | 2/1991 | Skaar et al. | 204/67 |
| 5,151,006 | A | 9/1992 | Marttila et al. | 414/626 |
| 5,435,897 | A | 7/1995 | Zannini | 204/245 |
| 5,730,855 | A | 3/1998 | Luebke et al. | 205/354 |
| 6,654,933 | B1 * | 11/2003 | Abbott et al. | 715/513 |

* cited by examiner

*Primary Examiner*—Roy King
*Assistant Examiner*—Nira S. Birenbaum
(74) *Attorney, Agent, or Firm*—Daniel P. Cillo; Eckert Seamans Cherin & Mellott, LLC

(57) ABSTRACT

A spent anode is replaced with a new anode in an electrolysis cell having an anode bus bar and an anode rod contacting the bus bar. A desired distance (D4) from the bus bar to a reference point on or adjacent to an anode rod for the new anode is calculated, the spent anode is replaced with a new anode so that the reference point on the new anode rod is spaced from the bus bar by an actual distance (D5), and the actual distance (D5) is measured at least once by means of a vision system. The actual distance (D5) is preferably adjusted using a feedback control loop in a computer so that D5 approaches the desired distance (D4).

9 Claims, 8 Drawing Sheets

PROCESS AND APPARATUS FOR POSITIONING REPLACEMENT ANODES IN ELECTROLYTIC CELLS

FIELD OF THE INVENTION

The present invention relates to a process and apparatus for the periodic replacement of anodes in electrolytic cells. More specifically, the invention relates to an improved process and apparatus for automatically and accurately positioning the height of new carbon anodes in cells producing aluminum by electrolysis of alumina in a molten salt bath.

BACKGROUND OF THE INVENTION

The well-known Hall-Heroult process produces aluminum by electrolysis of alumina dissolved in a molten fluoride salt bath maintained at temperatures of 900–1000° C. Alumina ($Al_2O_3$) produces aluminum and oxygen when it breaks down. Aluminum is collected in a molten layer below the anode and oxygen is released adjacent the anode.

Carbon is used as the anode material because oxidation-resistant anodes are not yet commercially available. Carbon is consumed in relatively large quantities in the process, generally about 420 to 550 kg. carbon per metric ton of aluminum produced.

A new anode includes a carbon block joined by stubs and an iron yoke to an aluminum or copper anode rod. The height of the carbon block in a new anode is about 62 cm. Its life span in a cell is about 27 days after which the height of the carbon block is reduced to about 15 cm. The spent anode must be replaced before it is completely consuned in order to avoid the risk of contaminating aluminum with steel from the stubs or with cast iron used for joining stubs into the carbon block. A small aluminum plant having 264 cells may replace close to 400 anodes per day, requiring about 150,000 anode replacements per year.

When a new anode replaces a spent anode in a cell, its height must be positioned accurately in order to assure efficient operation of the cell. The new anode should also be positioned quickly in order to minimize gas emission and cell perturbations. Several processes and apparatus for replacing anodes have been developed in the prior art. Some prior art patents covering various aspects of anode changing include Messina U.S. Pat. No. 3,850,305; Kato et al. U.S. Pat. No. 4,032,020; Duclaux U.S. Pat. No. 4,465,578; Skaar et al. U.S. Pat. No. 4,992,146; Marttila et al. U.S. Pat. No. 5,151006; Luebke et al. U.S. Pat. No. 5,730,855; and Zannini U.S. Pat. No. 5,435,897. However, there still remains a need for an efficient and economical process and apparatus for positioning new anodes accurately and quickly in an aluminum electrolysis cell.

A principal objective of the present invention is to provide an efficient and economical process and apparatus for automatically positioning the height of new anodes in an aluminum electrolysis cell.

A related objective of the invention is to provide a process and apparatus for reducing variations in the height of new anodes among different individuals operating the electrolysis cell.

An advantage of the present invention is that vertical positioning of new anodes is minimally subject to variations in position of the overhead crane supporting the anode changing apparatus.

Additional objectives and advantages of the invention will become readily apparent to persons skilled in the art from the following detailed description of some particularly preferred embodiments.

SUMMARY OF THE INVENTION

In accordance with the present invention there is provided a process and apparatus for automatically positioning replacement anodes in an electrolysis cell for producing a metal, preferably aluminum. Other metals produced by electrolytic processes include lead, magnesium, zinc, zirconium, titanium, and silicon. Electrolysis cells producing aluminum include at least one anode having an anode rod connected with a bus bar, a molten salt bath contacting the anode, and a cathode spaced from the anode. The molten salt bath includes a cryolite electrolyte and alumina dissolved in the electrolyte. An electric current passing through the electrolyte breaks down alumina into aluminum collected in a liquid layer below the anode and oxygen released adjacent the anode.

The anodes generally include a carbon block, a metal device anchored in the carbon block, and a metal rod connected with the device. The device is generally made of steel. The anode rod is made of aluminum or copper. The metal device may have 1, 2, 3, or 6 stubs anchored in the carbon block and preferably includes 3 stubs so that it is called a "tripod". The tripod is connected with the carbon block by a cast iron material called "rodding". The tripod is connected with the anode rod by an explosion welded joint called a "clad".

An upper portion of the anode rod preferably defines an opening called a "lifting slot" for connecting the anode rod with a pulling tool. A pin extends through the lifting slot and metal hooks (called "snugs") engage with the pin to raise and lower the anode rod. The snugs are connected by a device called a "connector" with a lifting tool supported by an overhead crane extending downwardly from an apparatus (called a "pot tending machine" or "PTM") extending between 2 main steel beams overhead. The PTM also includes a cabin or turret for housing an operator, and a crane supporting tools for replacing anodes, for siphoning metal from the cell, and for feeding aluminum fluoride to the cell.

Optionally, the PTM may also support one or more digital cameras, a computer, and a programmable logic controller ("PLC") for carrying out the process of the invention, as described below in greater detail.

Carbon in the anode blocks is consumed as aluminum is produced. Accordingly the spent carbon anodes must be replaced with new anodes approximately every 27 days. Because heat is lost from the cell while anodes are being exchanged, it is desirable to change the anodes quickly consistent with safety and other objectives of the plant. The new anodes must be positioned accurately to optimize aluminum production and to avoid anode effects. Positioning of the anodes is measured with reference to a bottom of the spent anodes and a bottom of the new anodes. The anode bus bar or a plane adjacent thereto is chosen as an absolute reference for vertical positioning. One advantage of the present invention is that distance measurements carried out for purposes of positioning new anodes do not rely upon a reference point on the overhead crane. Accordingly, variations in position of the overhead crane have little or no effect upon measurements of actual distances.

When replacing a spent anode with a new anode, the bottom of the new anode is positioned higher than the bottom of the spent anode by a predetermined distance X that is chosen to optimize cell performance. X may vary between about 10 and 20 mm. and is about 15 mm. in a particularly preferred embodiment.

In a preferred embodiment of the present invention, several measurements are performed to position the new anodes accurately. Before measuring, a first reference point named reference one (R1) is chosen. The reference one is related to the anode bus bar. A second reference point named reference two (R2) is chosen on the anode rod or somewhere else to link up with the anode rod.

In a first step, before a spent anode is removed from its connection with the anode bus bar a measurement is taken of the vertical distance between the reference one and the reference two. This distance, called the first distance or D1, is measured by a vision system that is preferably at least one digital camera or a digital laser distance detector, each being connected to a computer including an image processing algorithm locating the reference points and the vertical distance between them. The laser distance detector may be either a sweeping laser or a fixed beam.

In a second step, a crust above the carbon block is broken, connections between the anode rod and the bus bar are removed, and the spent anode is lifted from the cell. A second measurement is taken of the spent anode to determine the distance between the reference two and the bottom of the spent anode. This measured distance is called the second distance or D2. The spent anode is then placed in a storage rack for spent anodes. In a particularly preferred embodiment of the invention distances are measured by combining images obtained from 3 separate digital cameras installed on a mobile rigid arm. Digital cameras with images of 1,300 pixels×1,100 pixels are quite suitable for practice of the invention.

In a third step, a new anode is procured and lifted by a pulling tool supported by the overhead crane. The pulling tool preferably includes a load cell. A third measurement is taken of the distance between the bottom of the new anode and the reference two. The result is called the third distance or D3. An advantage of the present invention is that measurements D2 and D3 can be taken even if anodes are swinging.

By using the distances D1, D2 and D3, the computer calculates a desired distance D4 between references one and two for the new anodes. This calculation is in accordance with the formula:

$$D4=D3-D2+D1+X$$

where D1, D2, and D3 are defined above and X is 15 mm. in the most preferred embodiment. This value of X corresponds to the optimum distance for the bottom of the new anode to lie above the bottom of the spent anode.

After the desired distance (D4) is calculated, a new anode is positioned in the cell and the distance D5 between references one and two is measured. This measurement is carried out by at least one digital camera or by a digital laser distance detector and the resulting signal is sent to the PLC. The PLC compares D5 with desired distance D4 and if there is detectable difference, the PLC sends a signal to the overhead crane instructing the pulling tool to raise or lower the new anode as needed to minimize the difference between D5 and D4. Measurements of D5 and movements of the pulling tool are repeated as many times as needed to reduce the difference between D5 and D4 to an acceptable value. Then, the new anode is positioned and connected to the anode bus bar. A feedback of the difference between D4 and D5 can also be given to the crane operator to manually lower or raise the lifting tool.

DETAILED DESCRIPTION OF THE PREFERRED EMBODIMENTS

Figure 1:
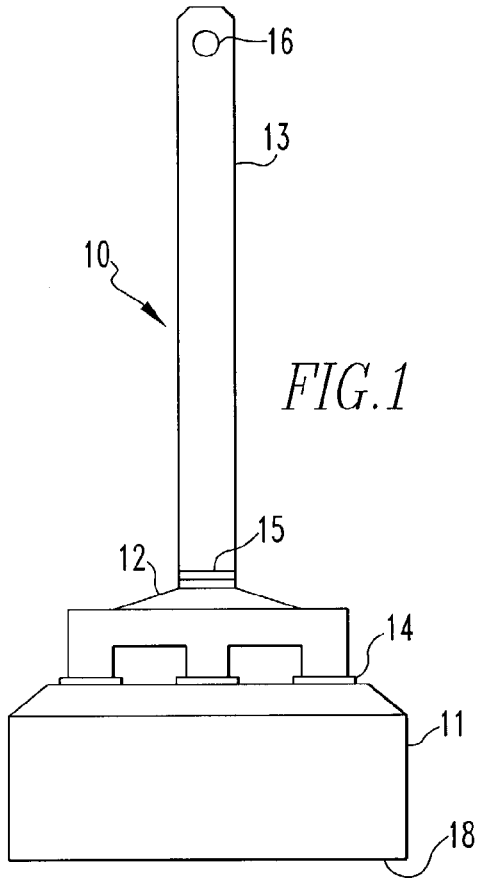
FIG. 1 is a front elevational view of a new anode for an aluminum electrolysis cell.

In accordance with a particularly preferred embodiment of the present invention there is provided a process and an apparatus for replacing a spent anode with a new anode in an electrolysis cell for making aluminum. As shown in FIG. 1, a new anode 10 includes a large carbon block 11, a steel tripod 12 having 3 prongs anchored in the carbon block, and a metal rod 13 extending upwardly of the tripod. The tripod 12 is connected with the carbon block 11 by cast iron rodding 14, a small portion of which is shown extending upwardly of a top surface of the carbon block 11. A clad 15 comprising an explosion welded joint connects the tripod 12 with the rod 13. The rod 13 defines a lifting slot 16 for connecting the rod 13 with a lifting tool, as described below. A bottom surface 18 of the anode block 11 lies in the anode plane of the new anode 10.

Figure 2:
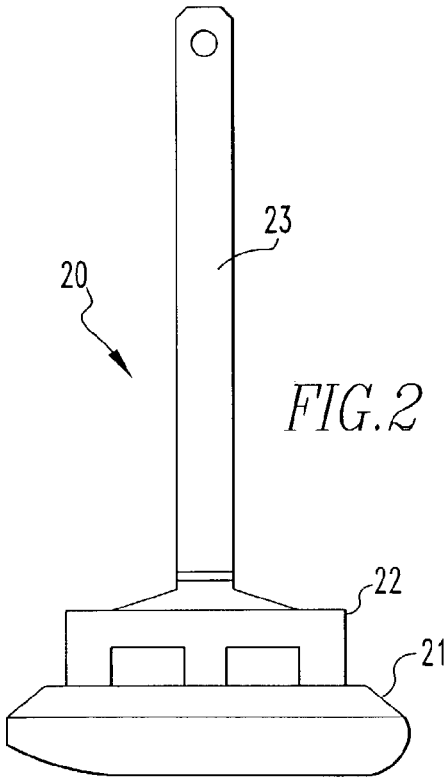
FIG. 2 is a front elevational view of a spent anode removed from an aluminum electrolysis cell.

The height of the anode block 11 in the new anode 10 of FIG. 1 is about 62 cm. In FIG. 2 there is shown a spent anode 20, removed from an aluminum electrolysis cell. The spent anode 20 includes a carbon block 21, a steel tripod 22, and an anode rod 23. In the spent anode 20, the height of the carbon block 21 is reduced to about 15 cm.

Figure 3:
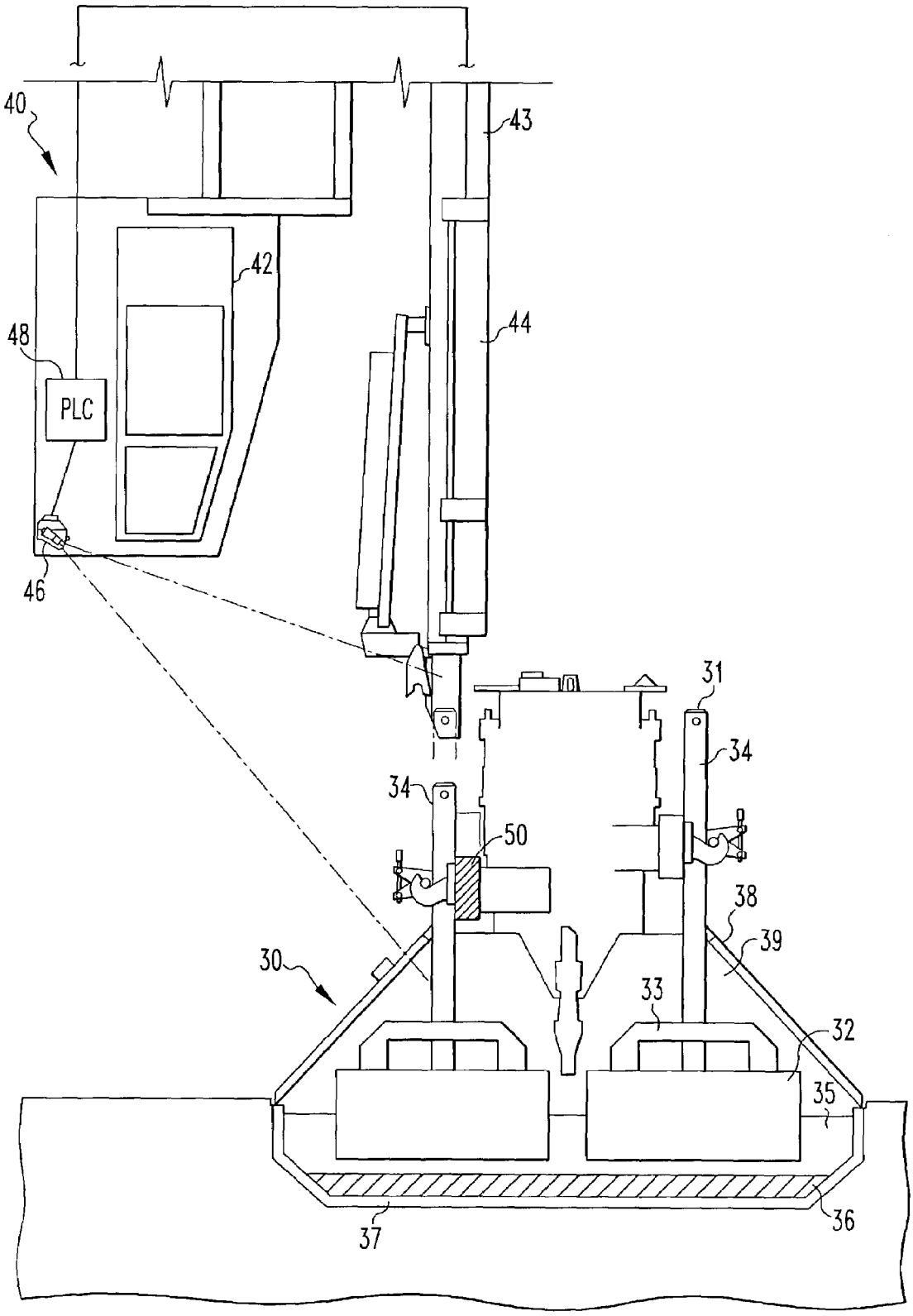
FIG. 3 is a front elevational view of an apparatus for replacing spent anodes with new anodes in accordance with the invention.

As shown in FIG. 3, an electrolysis cell 30 for producing aluminum includes anodes 31 each having a carbon block 32, a tripod 33, and an anode rod 34. The anodes 31 are suspended in a molten salt bath or cryolite electrolyte 35 above a molten metal pad 36 supported by a carbon cathode 37. A removable metal hood 38 prevents fumes from escaping a cell chamber 39 above the molten salt bath 35.

A pot tending machine or PTM 40 above the cell 30 is supported by 2 steel guide rails (not shown). The PTM 40 includes a cabin or turret 42 for housing an operator, an overhead crane 43 supporting a pulling tool 44 for raising and lowering the anodes 31 by gripping their rods 34, at least one digital camera 46 for measuring distances, and a programmable logic controller (PLC) 48 linked with the pulling tool 44 and camera 46. The pulling tool 44 positions the anode rods 34 adjacent an anode bus bar 50.

Figure 4A:
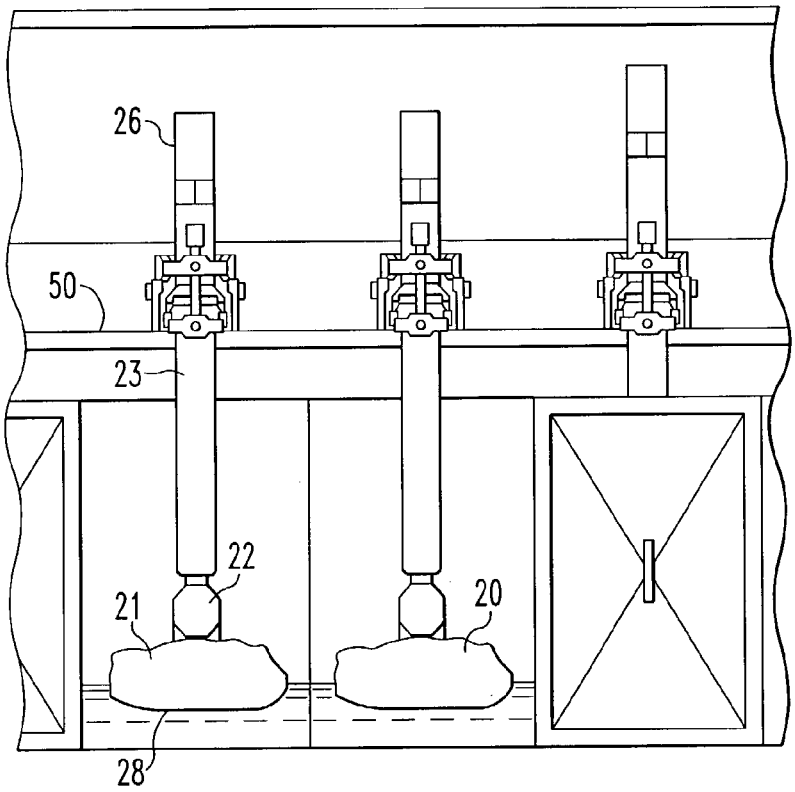
FIGS. 4A and 4B are schematic illustrations of an aluminum electrolysis cell.
Figure 4B:
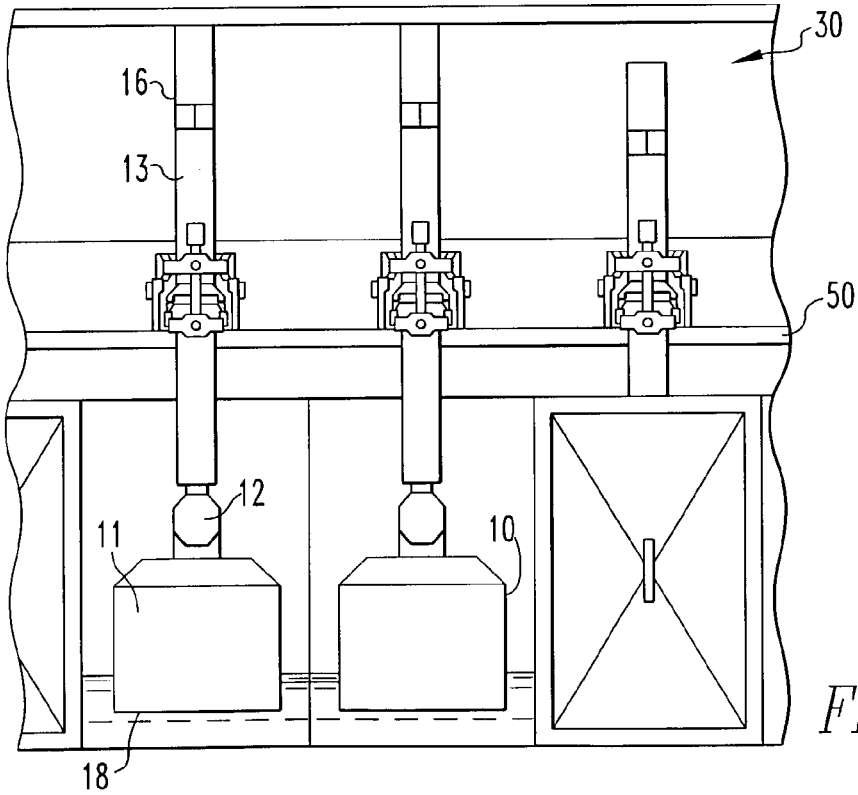

Referring now to FIG. 4A, there are shown schematically 2 spent anodes 20 in an aluminum electrolysis cell 30. FIG. 4B shows 2 new anodes 10 each including a carbon block 11, a tripod 12, and an anode rod 13 extending upwardly above a bus bar 50 (reference number one or R1). A lifting slot 16 in the anode rod 13 serves as a reference point for distance measurements (reference number two or R2). The new anode plane 18 is a bottom horizontal surface of the carbon block 11.

Referring again to FIG. 4A, the spent anode 20 includes a carbon block 21, a tripod 22, and an anode rod 23 extending above the bus bar 50. The rod 23 defines a lifting slot 26. The spent anode plane 28 is a bottom horizontal surface of the carbon block 21.

In FIG. 4B, the distance between the bottom 18 of the new anode and the anode bus bar 50 is called DA. Similarly in FIG. 4A the distance between the bottom 28 of the spent anode and the bus bar 50 is called DM. The cell 30 operates more efficiently after a new anode 10 is installed if the new anode bottom 18 is about 15 mm. higher than the spent anode bottom 28. In other words, the relation between DA and DM is preferably in accordance with the following formula:

$$DA=DM-15 \text{ mm.}$$

Figure 5:
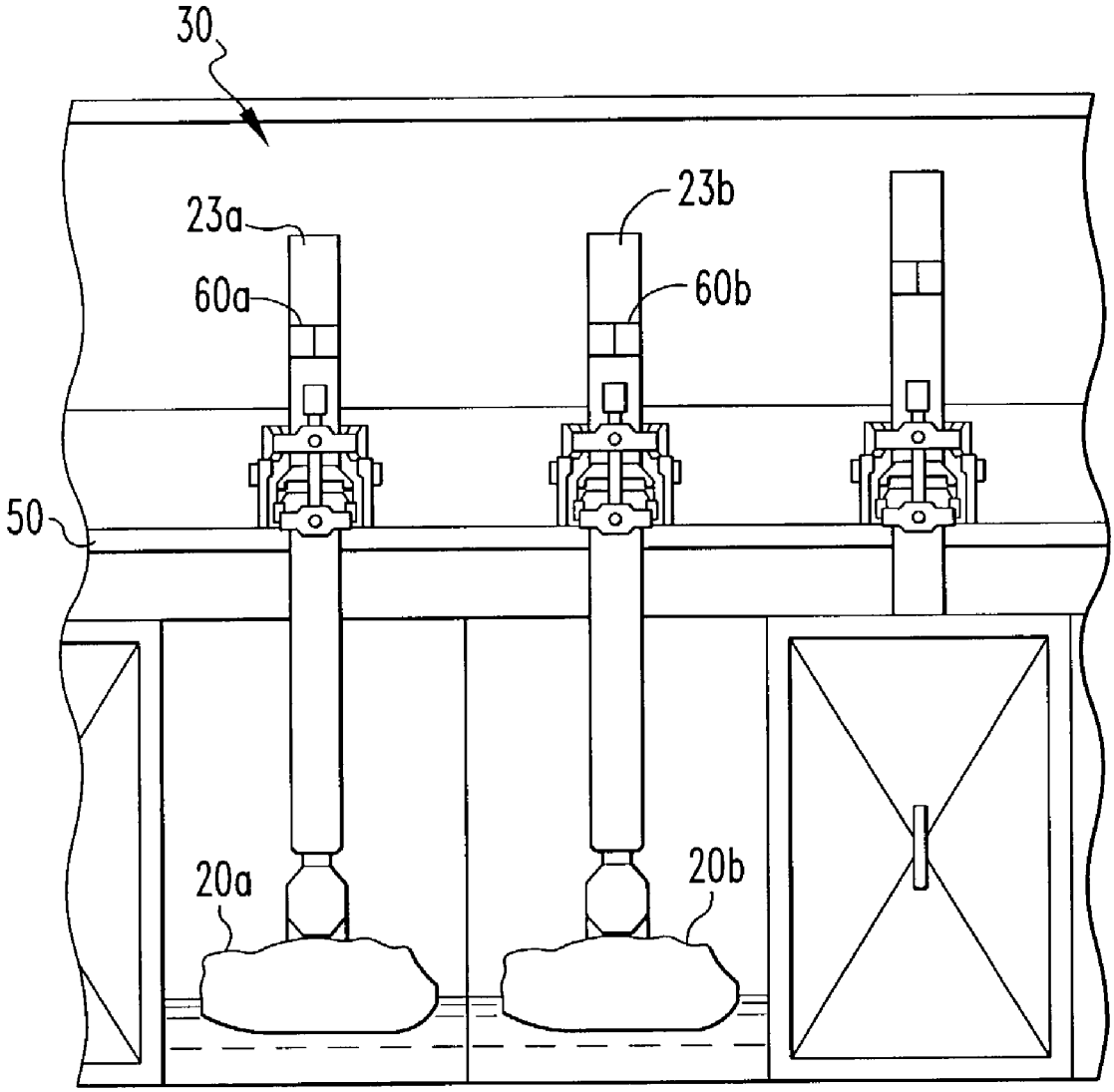
FIGS. 5–8 are schematic illustrations of distance measurements to be made in an aluminum electrolysis cell in accordance with a preferred embodiment of the invention.

Positioning a new anode in an electrolysis cell in accordance with a preferred embodiment of the present invention involves 4 distance measurements. Referring first to FIG. 5, before 2 spent anodes 20*a*, 20*b* are removed from the cell a digital camera takes a picture of the anode rods 23*a*, 23*b* either singly or both at the same time. The picture must show the anode bus bar 50 and the reference points 60*a*, 60*b* adjacent the lifting slots. An image processing algorithm locates the reference points 60*a*, 60*b* and the bus bar 50 to evaluate the vertical distances (D1, D1') between them.

Figure 6:
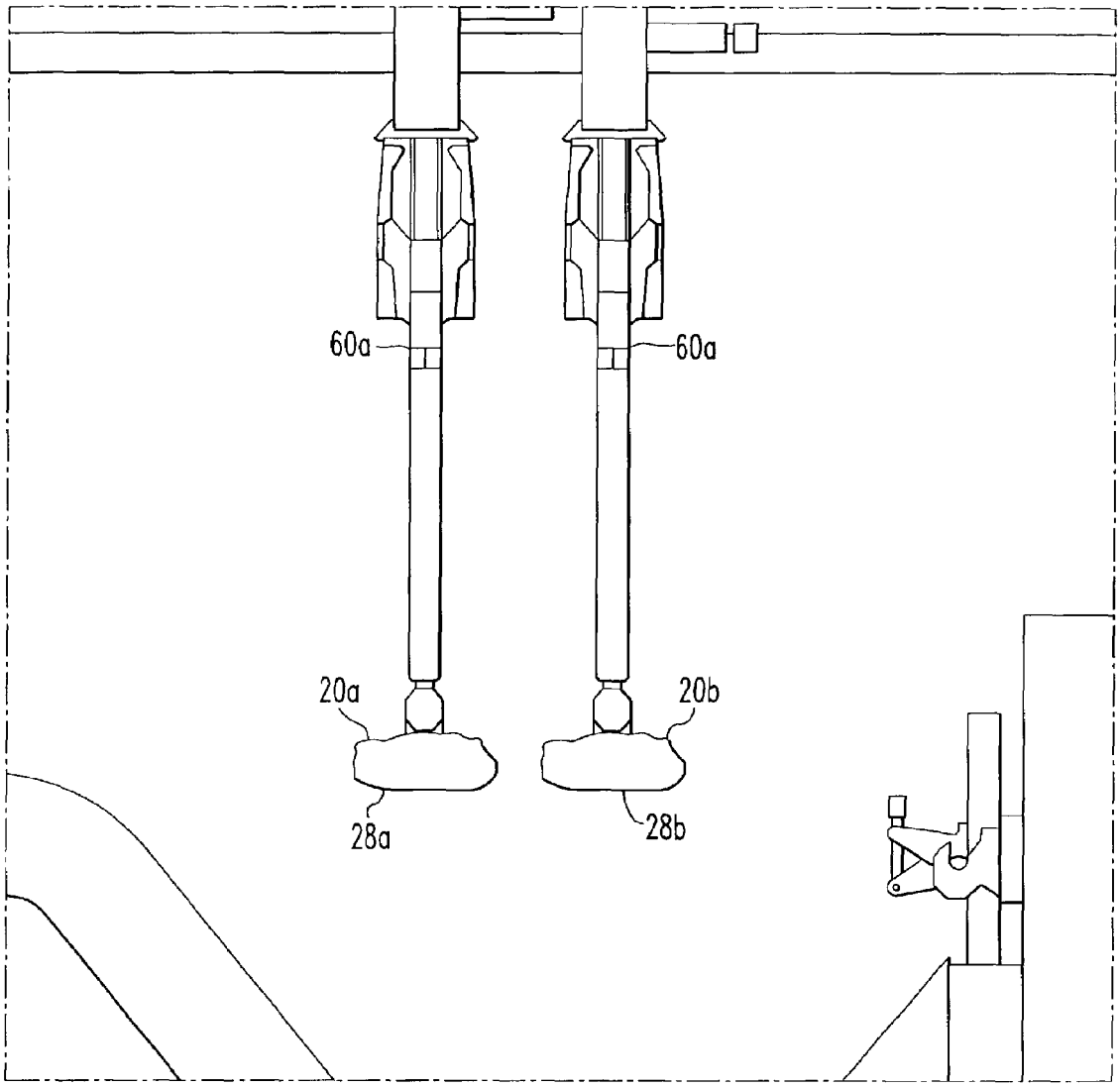

Before conducting the second measurement step the crust is broken, connections between the anode rods 23*a*, 23*b* and the bus bar 50 are removed, and the spent anodes 20*a*, 20*b* are lifted out from the cell. A second digital picture is taken of each spent anode 20*a*, 20*b* singly or both at the same time, showing the distances (D2, D2') between the reference points 60*a*, 60*b* and the anode planes 28*a*, 28*b* for each spent anode as shown in FIG. 6. The picture may be taken at any time after the spent anodes 20*a*, 20*b* are lifted from the cell and until they are placed on the spent anode rack. An image processing algorithm locates the reference points 60*a*, 60*b* and the anode planes 28*a*, 28*b* to evaluate the vertical distances (D2, D2') between them.

Figure 7:
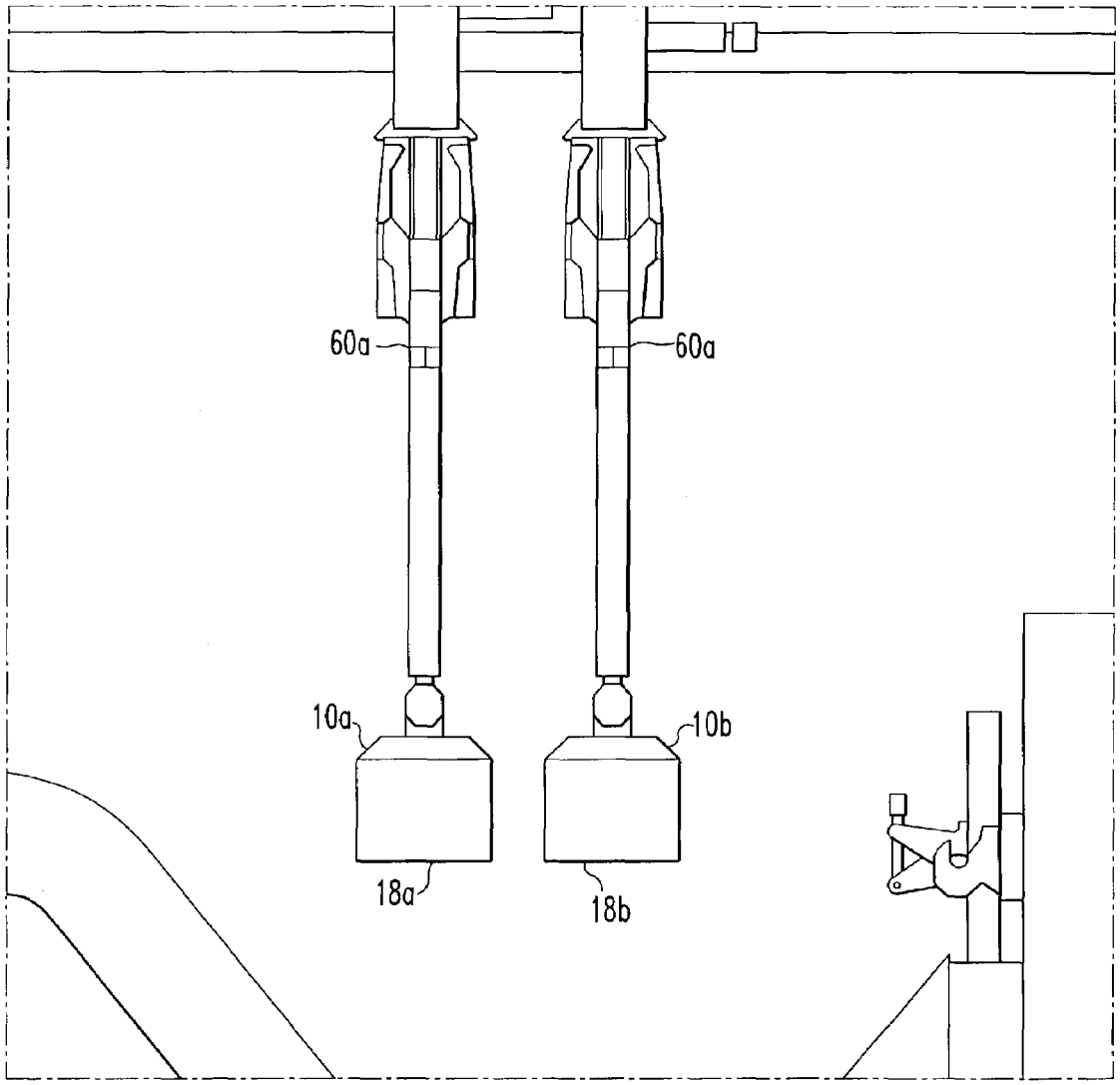

The spent anodes 20*a*, 20*b* are places on an anode rack (not shown) and 2 replacement anodes 10*a*, 10*b* are lifted as shown in FIG. 7. A third picture is taken by the digital camera of each new anode 10*a*, 10*b* individually or both at the same time. This picture can be taken anywhere on the path taken by the new anodes 10*a*, 10*b* from the time they are raised above the rack and the time they are above the cell. An image process algorithm locates the reference points 60*a*, 60*b* on the new anodes and their anode planes 18*a*, 18*b*, to evaluate the distances (D3, D3') between them.

The desired distances (D4, D4') between the bus bar 50 and the reference points 60*a*, 60*b* are now calculated according to the formula:

$$D4=D3-D2+D1+15 \text{ mm.}$$

Figure 8:
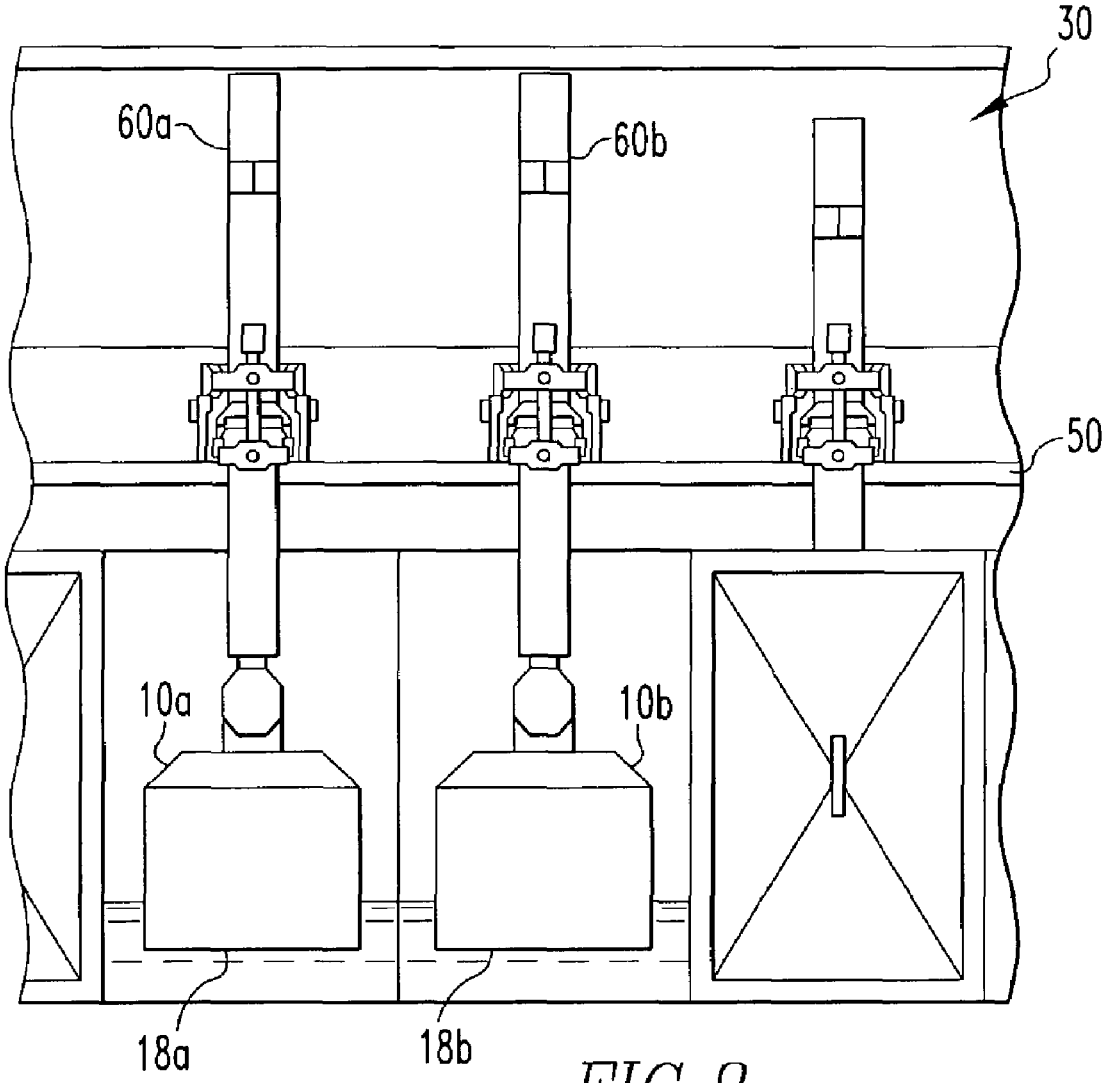

The new anodes 10*a*, 10*b* are then lowered into the cell 30 and positioned at a height selected by the operator. The connectors are put back in place without tightening them. As shown in FIG. 8, a picture is then taken of both new anodes 10*a*, 10*b*, showing their reference points 60*a*, 60*b* and the anode bus bar 50 to evaluate the vertical distance (D5, D5') between them. The algorithm takes measurements about 2–5 times per second and communicates them to the PLC. The measurements are used as a feedback to a control loop on the vertical positions of the new anodes 10*a*, 10*b*, using the calculated values (D4, D4') as set points, and vertical positions of the reference points 60*a*, 60*b* are adjusted accordingly. After this control loop completes its action, the bottoms 18*a*, 18*b* of the new anodes 10*a*, 10*b* are each located 15 mm. above where the bottoms 28*a*, 28*b* on the spent anodes 20*a*, 20*b* were located.

Figure 9:
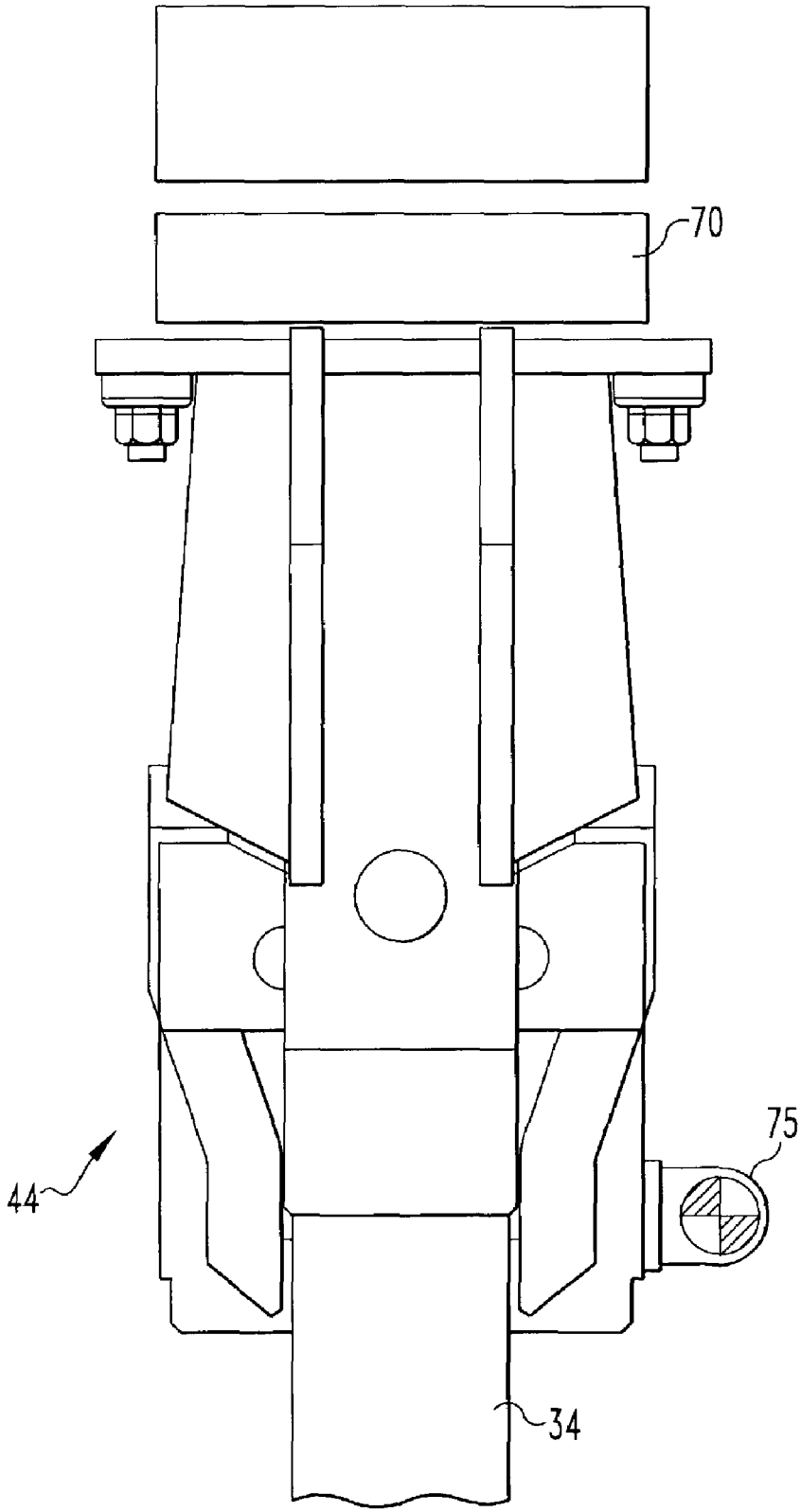
FIG. 9 is a fragmentary, front elevational view of an alternative embodiment for the implementation of reference 2.

An alternative embodiment of an apparatus of the invention shown in FIG. 9 includes a load cell 70 above a pulling tool 44 gripping the anode rod 34. A tag 75 extending laterally of the anode rod 34 is substituted for a slot in the anode rod as reference two (R2). A target inscribed onto the tag 75 provided a convenient and readily visible reference point for measuring distances D1, D2, D3, and D5 in accordance with the procedures described above.

Having described the presently preferred embodiments, it is to be understood that the invention may be otherwise embodied within the scope of the appended claims.

What is claimed is:

1. A process for replacing anodes in an electrolysis cell comprising a bus bar and at least one anode having an anode rod connected with said bus bar, comprising the steps:

(a) calculating a desired distance (D4) from said bus bar to a reference point on or adjacent to an anode rod for a new anode to replace a spent anode in said cell, where the bus bar is chosen as an absolute reference for vertical positioning, said calculation comprising the steps:

(1) measuring a first distance (D1) from said bus bar to a reference point on or adjacent to an anode rod for said spent anode, (2) measuring a second distance (D2) from a suitable location on or adjacent to a bottom of said spent anode to said reference point on or adjacent to said anode rod for the spent anode, (3) measuring a third distance (D3) from a suitable location on or adjacent to a bottom of said new anode to said reference point on or adjacent to said anode rod for the new anode, and (4) calculating said desired distance (D4) as follows: D4=D3−D2+D1+X, wherein X is a predetermined distance between said bottom for the spent anode and said bottom for the new anode, (b) replacing said spent anode with said new anode so that said reference point is spaced from the bus bar by an actual distance (D5), (c) measuring said actual distance (D5) by means of at least one laser distance detector associated with and sending signals to a programmable logic controller (PLC) which compares the actual distance (D5) with the desired distance (D4) and controls raising or lowering the new anode, and, (d) repeating step (c) at least once, to reduce the distance between the actual distance (D5) and the desired distance (D4) to an acceptable level.

2. The process of claim 1, wherein X is in a range of about 10–20 mm.

3. The process of claim 1, wherein X is about 15 mm.

4. The process of claim 1, wherein steps (c) and (d) include said PLC sending a signal to a pulling tool connected with said anode rod for the new anode, said pulling tool adjusting said actual distance (D5) so that it approaches the desired distance (D4), and the laser used in the laser distance detector is selected from a sweeping laser or a fixed beam laser, and first distance (D1) is measured by at least one laser distance detector associated with a computer including an image processing algorithm.

5. The process of claim 4, wherein said pulling tool is supported by an overhead crane.

6. The process of claim 4, wherein said PLC includes a feedback control loop for minimizing any difference between D5 and D4.

7. The process of claim 1, wherein each said anode comprises a carbon block and each said anode rod comprises steel.

8. The process of claim 7, wherein each said anode rod defines a lifting slot.

9. The process of claim 1, wherein said electrolysis cell produces aluminum by electrolysis of alumina in a molten salt bath.

* * * * *